US006349866B1

(12) United States Patent
Stewart et al.

(10) Patent No.: US 6,349,866 B1
(45) Date of Patent: Feb. 26, 2002

(54) PAPERBOARD CAN WITH AN INTEGRATED PAPERBOARD LID HAVING A HINGE ON THE LID

(75) Inventors: Noel G. Stewart; L. David Fielder, both of Oxford, GA (US); Angela L. Rowland, Collegeville, PA (US); Suzanne Theresa Barker, St. Louis Park, MN (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 09/437,968

(22) Filed: Nov. 10, 1999

Related U.S. Application Data

(60) Provisional application No. 60/120,030, filed on Feb. 13, 1999.

(51) Int. Cl.[7] ..... B65D 43/16; B65D 43/18

(52) U.S. Cl. ..... 225/125.09; 229/125.17; 229/221; 229/223; 229/229; 220/259

(58) Field of Search ..... 229/125.17, 125.09, 229/210, 221, 223, 229; 220/256, 554, 259, 270, 837

(56) References Cited

U.S. PATENT DOCUMENTS

| | | | | |
|---|---|---|---|---|
| 1,305,630 A | | 6/1919 | Swerdfeger | |
| 1,431,561 A | | 10/1922 | Blain | |
| 1,462,443 A | * | 7/1923 | Brooks | 229/125.17 X |
| 1,773,553 A | | 8/1930 | Taylor et al. | |
| 1,851,287 A | * | 3/1932 | Moore | 229/5.6 |
| 1,884,545 A | | 10/1932 | Boutin | |
| 1,951,274 A | | 3/1934 | Denman | |
| 1,961,055 A | | 5/1934 | Lewin | |
| 2,108,431 A | | 2/1938 | Cornwall | |
| 2,120,898 A | | 6/1938 | Moore | |
| 2,120,904 A | | 6/1938 | Moore | |
| 2,141,011 A | | 12/1938 | Monk | |
| 2,146,226 A | | 2/1939 | Punte | |
| 2,152,400 A | | 3/1939 | Rold | |
| 2,179,231 A | | 11/1939 | Moore | |
| 2,431,744 A | | 12/1947 | Fessenden | |
| 2,719,663 A | | 10/1955 | Meyer-Jagenberg | |
| 2,802,613 A | | 8/1957 | Boyd | |
| 2,808,194 A | | 10/1957 | Dols | |
| 2,847,151 A | | 8/1958 | Meyer-Jagenberg | |
| 2,923,445 A | | 2/1960 | Klausmann | |
| 2,931,554 A | | 4/1960 | Matern | |
| 2,970,736 A | * | 2/1961 | Baughan | 229/5.6 |
| 2,971,686 A | * | 2/1961 | Huhlhoff | 229/125.17 X |
| 3,026,013 A | | 3/1962 | Ullrich et al. | |
| 3,090,542 A | | 5/1963 | Miller | |
| 3,127,082 A | | 3/1964 | Meyer-Jagenberg | |
| 3,180,552 A | | 4/1965 | Atkinson, Jr. | |
| 3,302,858 A | | 2/1967 | Miller | |
| 3,334,797 A | | 8/1967 | Latham et al. | |
| 3,373,916 A | | 3/1968 | Montagano | |

(List continued on next page.)

FOREIGN PATENT DOCUMENTS

| | | |
|---|---|---|
| EP | 0 540 923 | 5/1993 |
| EP | 0 611 703 | 8/1994 |
| FR | 2695625 | 3/1994 |
| GB | 393199 | 6/1933 |

*Primary Examiner*—Stephen P. Garbe
*Assistant Examiner*—Tri M. Mai
(74) *Attorney, Agent, or Firm*—Dick and Harris

(57) ABSTRACT

A paperboard container for releasably dispensing contents contained therein is convertible from a substantially sealed orientation to a substantially open, dispensing orientation and back to the substantially sealed orientation. The paperboard container comprises a tubular container member, a bottom member and a top member, with the top member being telescopically received within the container member to seal the top member to the container. The top member is pivotable about the hinge portion and is pivotable to the sealed orientation to substantially reseal the container member.

13 Claims, 5 Drawing Sheets

U.S. PATENT DOCUMENTS

| | | | | |
|---|---|---|---|---|
| 3,391,852 | A | | 7/1968 | Waldrop |
| 3,648,919 | A | | 3/1972 | Anderson |
| 3,893,566 | A | | 7/1975 | Ross |
| 3,900,155 | A | | 8/1975 | Rausing et al. |
| 3,973,719 | A | | 8/1976 | Johnson et al. |
| 4,094,456 | A | | 6/1978 | Raccaforte |
| 4,280,653 | A | | 7/1981 | Elias |
| 4,312,450 | A | | 1/1982 | Reil |
| 4,401,229 | A | | 8/1983 | Bell et al. |
| 4,433,808 | A | | 2/1984 | Gordon et al. |
| 4,491,252 | A | | 1/1985 | Schmidt et al. |
| 4,579,246 | A | | 4/1986 | Swearinen et al. |
| 4,583,679 | A | | 4/1986 | Johnson |
| 4,673,126 | A | | 6/1987 | Hambleton |
| 4,715,528 | A | | 12/1987 | Kjelgaard et al. |
| 4,768,703 | A | | 9/1988 | Sosler et al. |
| 4,771,936 | A | | 9/1988 | Dolby |
| 4,775,098 | A | * | 10/1988 | Peer, Jr. et al. ..... 229/123.3 |
| 4,909,395 | A | | 3/1990 | Weissman |
| 4,913,292 | A | | 4/1990 | Field |
| 4,930,682 | A | | 6/1990 | Gordon et al. |
| 4,998,669 | A | | 3/1991 | Rausing |
| 5,002,222 | A | | 3/1991 | Giblin |
| 5,014,888 | A | | 5/1991 | Bryan |
| 5,027,999 | A | | 7/1991 | Kucherer |
| 5,067,615 | A | | 11/1991 | Davitian |
| 5,080,233 | A | | 1/1992 | Wyberg |
| 5,135,159 | A | | 8/1992 | Giblin et al. |
| 5,141,150 | A | | 8/1992 | Plaessmann |
| 5,400,914 | A | | 3/1995 | Lin |
| 5,636,732 | A | * | 6/1997 | Gilels et al. ..... 220/259 X |
| 5,647,500 | A | | 7/1997 | Konno et al. |
| 5,772,606 | A | | 6/1998 | Kaneko et al. |
| 5,806,757 | A | | 9/1998 | Per et al. |

* cited by examiner 21
23
16
9
6
15
6
1
3

21
9
17
19
5
1
3
7
11
16
15
17
36
37
21
19
1
3

FIG. 4
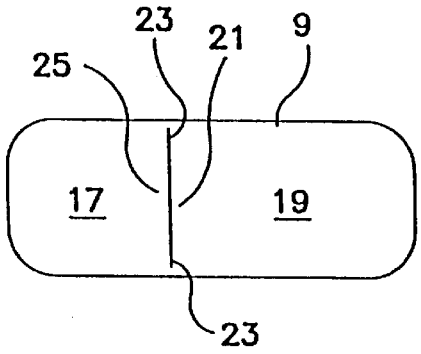
FIG. 5A
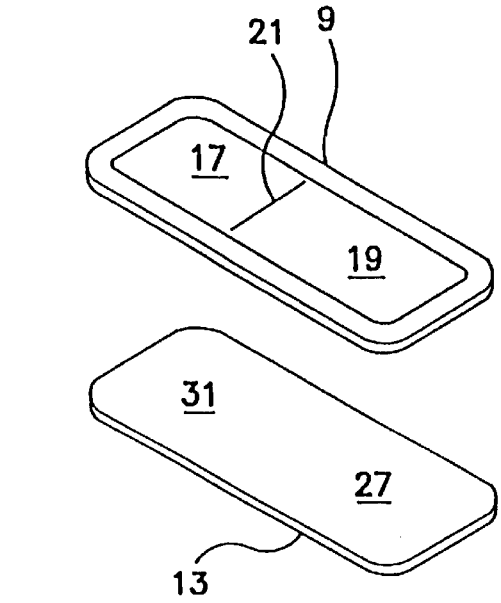
FIG. 5B
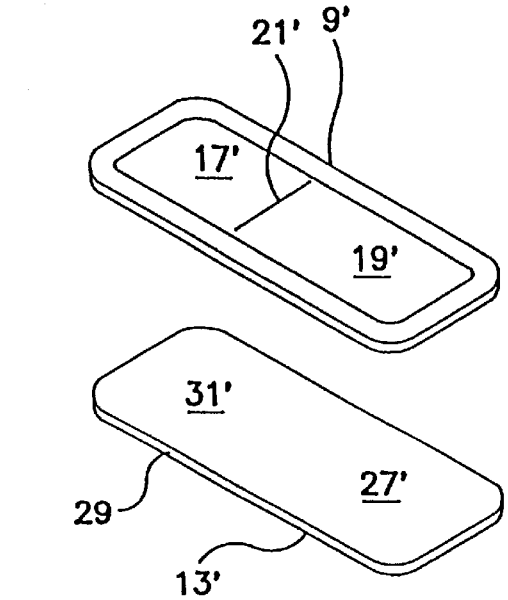
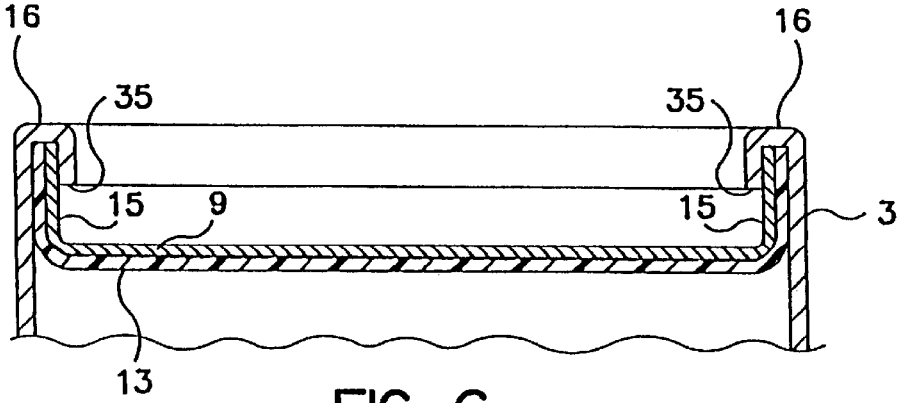
FIG. 6

PAPERBOARD CAN WITH AN INTEGRATED PAPERBOARD LID HAVING A HINGE ON THE LID

CROSS-REFERENCE TO RELATED APPLICATIONS

This application claims the benefit of U.S. Provisional Application No. 60/120,030, filed Feb. 13, 1999.

STATEMENT REGARDING FEDERALLY SPONSORED RESEARCH OR DEVELOPMENT

Not Applicable. REFERENCE TO A "MICROFICHE APPENDIX"

Not Applicable.

BACKGROUND OF THE DISCLOSURE

1. Field of the Invention

The present invention is directed to paperboard lids for paperboard containers and, more specifically, to an integrated paperboard lid having a hinge on the lid.

2. Background Art

Paper containers are often used to hold consumer items such as cereals, grains, etc. To open the container, often, the consumer simply opens the entire top of the container. This allows access to the inner liner that holds the products. This arrangement is typical of boxes of breakfast cereal. Other boxes include a perforated portion on the side of the box, near the top, or on the top of the box, near the side. The perforated portion, when separated from the box, creates an openable flap that allows access to the interior of the box. This type of construction, which is often found on boxes of grain, soap and other products, does not allow for effective closing of the box.

It is therefore an object of the present invention to provide a container that is convertible from a substantially sealed orientation to a substantially open, dispensing orientation and back to the substantially sealed orientation.

It is also an object of the present invention to provide a container that is capable of remaining in a substantially open, dispensing orientation without obstructing the dispensing of contents contained therein.

It is a further object of the present invention to provide a container that is capable of reclosing from a substantially open orientation to a substantially sealed orientation without the loss of contents contained therein.

These and other objects of the present invention will become apparent in light of the present specification, claims and drawings.

SUMMARY OF THE INVENTION

The invention comprises a paperboard container for releasably dispensing contents contained therein. The container is convertible from a substantially sealed orientation to a substantially open, dispensing orientation and back to the substantially sealed orientation. The container includes a substantially tubular container member, a paperboard bottom member and a paperboard top member.

The container member has an upper edge defining an upper opening and a lower edge defining a lower opening. The bottom member substantially corresponds in shape to the shape of the lower opening, and the top member substantially corresponds in shape to the shape of the upper opening. The top member circumference is larger than the circumference of each of the upper edge and the upper opening of the container member.

The top member has a front portion, a hinge portion, a back portion, an outer edge and a circumference. The top member is telescopically received within the upper opening of the container member, and the upper edge of the container member is rolled up over the outer edge of the top member to seal the top member to the paperboard member. The top member is also pivotable to the sealed orientation to substantially reseal the container member.

In one embodiment, the container includes a membrane adhered to inner surfaces of the container member below the container top member. The membrane has a back portion and a front portion. The back portion is substantially equal in width to the width of the top member, and the front portion has a width which is less than the width of the top member and substantially equal in width to the width of the container member. Preferably, the membrane is made of barrier protective materials.

The hinge portion includes means for maintaining the hinge portion in a pivoted position relative to the remainder of the top member, and the maintaining means is located substantially adjacent the hinge axis. In one embodiment, the hinge portion extends generally straight across the top member and the hinge portion buckles under the top member back portion to create a friction fit that holds the top member front portion in its opened position. Moreover, the hinge portion includes outer portions and an inner portion extending between the outer portions, with the outer portions and the inner portion defining the hinge portion. The hinge portion is also sized to engage the membrane when the top member front portion is in its open orientation and to hold the front portion in the open orientation.

In another embodiment, the hinge portion includes a pair of outer segments, a pair of inner segments spaced axially from the outer segments, and a pair of axial segments joining the inner and outer segments. The top member hinge portion further includes a tab extending rearwardly toward the top member back portion. The tab is sized to engage the membrane when the top member front portion is in its open orientation and to hold the front portion in the open orientation. Preferably, the tab extends between the inner segments of the hinge portion.

In yet another embodiment, the top member front portion includes at least one tooth for engaging the container member upper edge when the top member is in its sealed orientation.

In another embodiment, the hinge portion includes at least two tabs extending rearwardly toward the top member back portion. The tabs are sized to engage the membrane when the top member front portion is in its open orientation and to hold the front portion in the open orientation.

In another alternative embodiment of the invention, the top member front portion has an opening extending therethrough, the top member hinge portion is positioned within the top member front portion, and the top member hinge portion includes a closure flap extending rearwardly toward the top member back portion for covering the opening. The closure flap further includes a tab for facilitating manipulation of the closure flap from a sealed orientation to an open, dispensing orientation. In this embodiment, resistance at the hinge portion manually biases the closure flap into both its open and closed orientations. The cover member further includes a tab for facliitating the manipulation of the top member from its sealed orienatation to its open, dispensing orientation.

BRIEF DESCRIPTION OF THE DRAWINGS

FIG. 4 is a plan view of a blank from which the lid of FIG. 1 is made;

FIG. 5*a* is a perspective, exploded view of an alternative blank from which the lid is made, this lid including a laminated underside;

FIG. 5*b* is a perspective, exploded view of an alternative blank from which the lid is made, this lid also including a laminated underside;

FIG. 6 is a cross-sectional view taken along lines 6—6 of FIG. 1, and looking in the direction of the arrows, showing the lid of FIG. 5 used to cover the container;

DETAILED DESCRIPTION OF THE DRAWINGS

Figures 1, 2, 3:
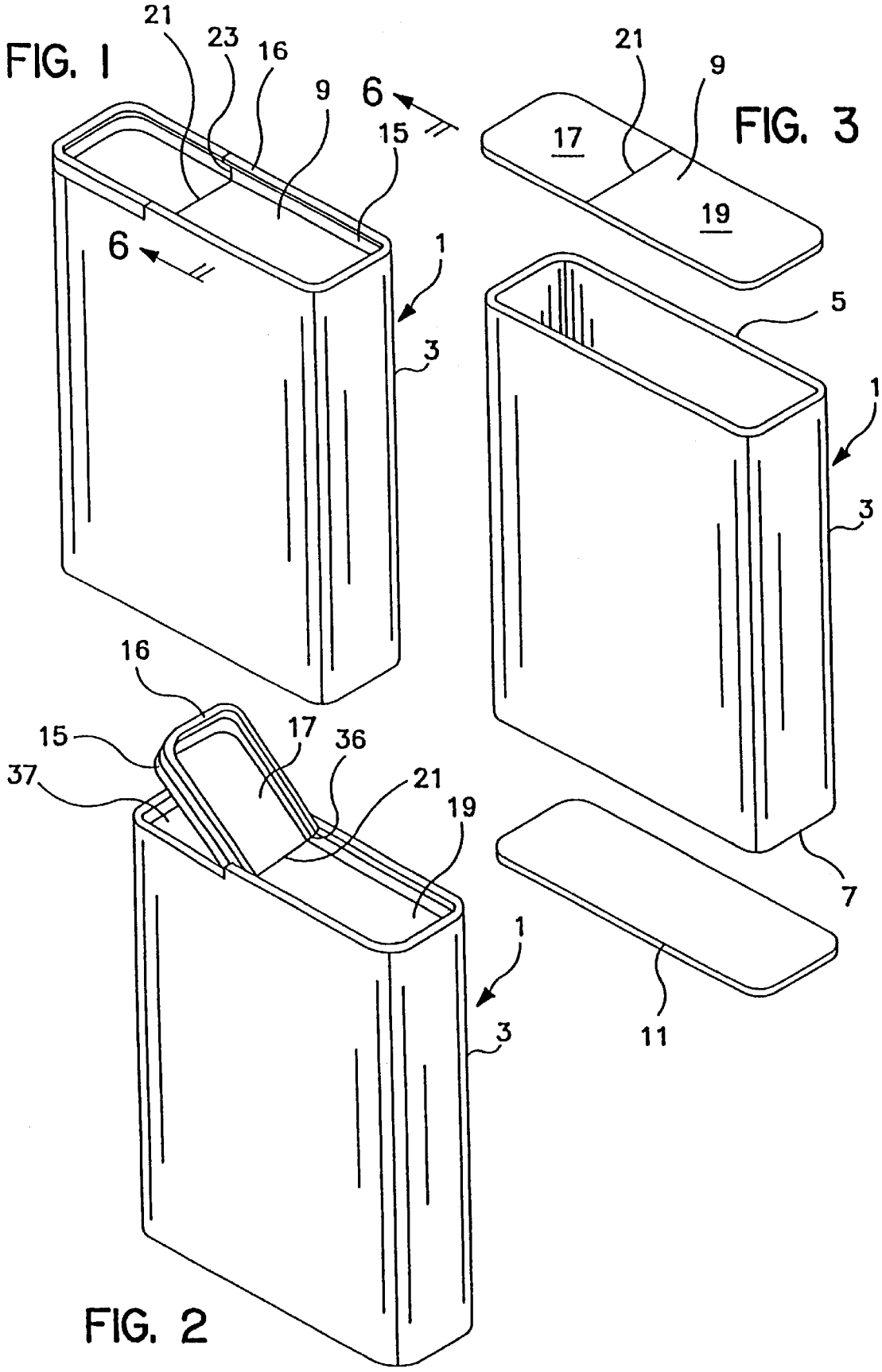
FIG. 1 is a perspective view of a container of the present invention, with the container being closed.
FIG. 2 is a perspective view showing the container of FIG. 1 with the lid opened.
FIG. 3 is an exploded view of the container of FIG. 1.

While this invention is susceptible of embodiment in many different forms, they are shown in the drawings and will be described in detail herein, several specific embodiments with the understanding that the present invention is to be considered as an exemplification of the principles of the invention and is not intended to limit the invention to the embodiments illustrated.

One embodiment of a paperboard container 1 of the present invention is shown generally in FIGS. 1–3. The container 1 includes a main body or tube portion 3 having a top edge 5 and a bottom edge 7. The body 3 has side walls defining a chamber that is opened at its top and bottom. The body 3 shown in the drawings is generally quadrilateral in plan view. However, the body could be circular, triangular, or any other desired shape. A top member 9 and a bottom member 11 are provided to close the top and bottom openings of the body 3. The top and bottom members 9 and 11 are of the same shape and size. They are also generally in the same shape as the body 3, but are proportionally larger than the body 3. That is, the circumference of the top and bottom members 9 and 11 is greater than the circumference of the body portion 3.

The top member 9 can be a single ply. Alternatively, as seen in FIGS. 5*a* and 6, a laminate 13 can be applied to the bottom surface of the top member 9 to form a top member assembly. Likewise, as shown in FIG. 5*b,* a laminate 13' can be applied to the bottom surface of the top member 9' to form a top member assembly.

To apply the top and bottom members 9 and 11 to the body 3, the respective member is pressed into the body 3, as seen in FIG. 6. When the member is pressed into the body 3, the peripheral edges 15 of the member will be turned up (in the case of top members 9 and 9'). The member is pushed into the body until the outer edge of the member is below the top (or above the bottom) edge of the body 3. The edge of the body 3 is then rolled over to form a lip 16 that extends around the circumference of container 1.

As seen in FIG. 4, the top member 9 includes a front portion 17 and a rear portion 19 separated by a line 21. The line 21 includes cuts, perforations, or other lines of weakness 23 that extend inwardly from the side edges of the top member 9. The lines of weakness 23 are then separated by a fold line 25. As seen in FIG. 1, the slice 23 extends up the peripheral portion 15 of the top member 9.

As seen in FIG. 5*a,* in the top member 9, the laminate 13 has a back portion 27 having a side-to-side width substantially equal to the side-to-side width of the top member 9. The laminate back portion 27 is substantially as long as the top member rear portion 19, and extends from the back edge of the top member 9 to the line 21. As shown in FIG. 5*b,* at approximately line 21, laminate 13' steps down, as at 29, to form the front portion 31' of laminate 13'. The laminate front portion 31' has a side-to-side width approximately equal to the side-to-side width of the body 3 (which is less than the side-to-side width of the top member 9'). Additionally, the laminate front portion 31' does not extend to the front edge of the top member 9'. Rather, it is sized to extend to the front edge of the body 3 when the top member assembly is placed in the body 3.

After the top member 9 is applied to the container body 3, a cut, perforation, or other line of weakness 23 is formed beneath the top edge 5 of the container 1. The cut 23 is positioned on the body 3 to be approximately equal with or slightly below the bottom of the lip 16 (i.e., the original top edge 5 of the body 3). The cut 23, however, is above the upper surface of the top member 9, as is best seen in FIG. 2. The cut 23 extends from a point co-linear with the top member line 21 around the front of the body 3 and back to a point co-linear with the top member line 21. The cut 23 thus enables the front portion 17 of the cover 9 to be lifted up, as seen in FIG. 2. As seen in FIG. 2, when the cover front portion 17 is lifted to its opened position, the lower part of the lip 16 is exposed. Additionally, when the cover front portion 17 is opened, the rear edges 36 of the lip 16 are forced inside of the lip of the cover rear portion 19. The two portions create a friction fit that holds the cover front portion 17 in its opened position. Further, because the lip 16 is exposed below the cut 23, the lip 16 will frictionally engage the wall of the container body 3 when the cover forward portion 17 is closed, as shown in FIG. 1. This will help retain the cover forward portion 17 in its closed position.

As seen in FIG. 2, the container 1 can include a membrane or seal 37 below cover member 9. The seal 37 closes the container below the cover 9 and must be broken before product can be poured from the container 1.

Figure 7:
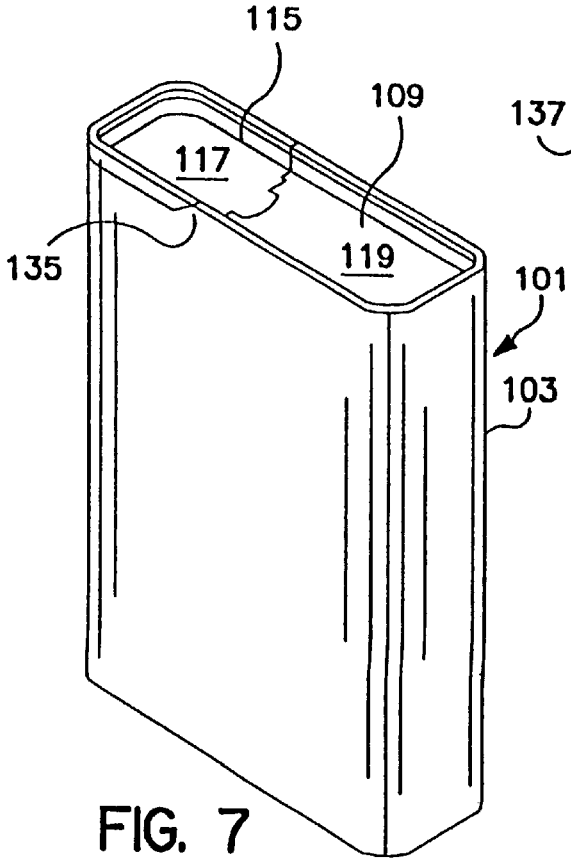
FIG. 7 is a perspective view of the container of FIG. 1, with an alternative lid construction, with the lid being closed.
Figure 8:
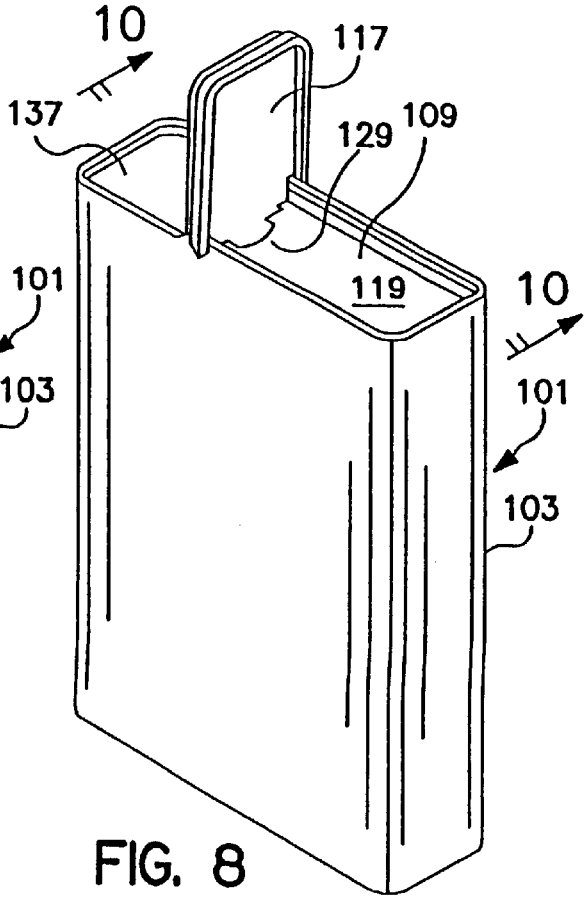
FIG. 8 is a perspective view of the container of FIG. 7, with the lid being open.
Figure 9:
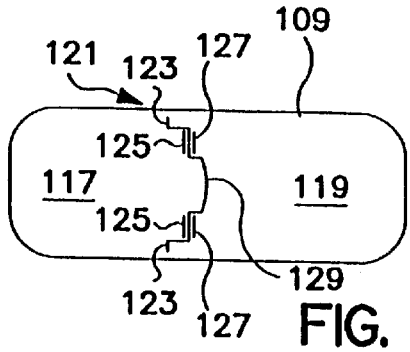
FIG. 9 is a plan view of a blank used to form the lid for the container of FIG. 7.

A second embodiment of the cover member is shown in FIGS. 7–10. The container 101 of FIGS. 7 and 8 is substantially identical in construction to the container 1 of FIGS. 1 and 2. It varies only in the construction of the cover member 109. The cover member 109, in turn, is substantially similar to the cover member 9. The difference lies in the line 121 that separates the cover front portion 117 from the cover back portion 119. The line 121 (FIG. 9) includes opposing outer scores 123 which have outer ends spaced from the side edges of the cover member 109 and extend inwardly slightly. A second pair of opposing scores 125 extend rearwardly (and orthogonally) from the inner edges of the first score lines 121. A pair of inner fold lines 127 extends inwardly from the ends of the second score lines. Lastly, a tab 129 connects the inner ends of the fold lines 127. The tab 129 is formed to extend toward the cover rear portion 119.

Figure 10:
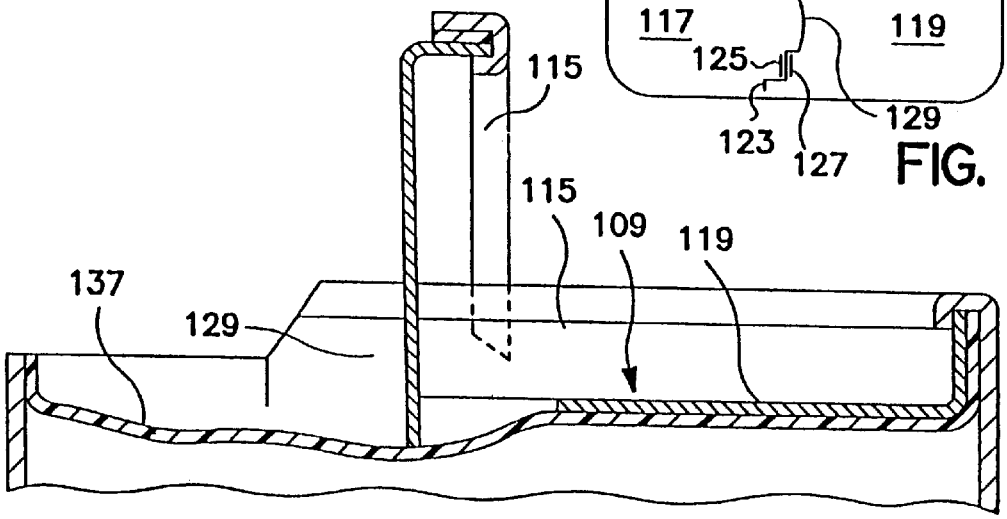
FIG. 10 is a cross-sectional view taken along lines 10—10 of FIG. 8, and looking in the direction of the arrows, showing the lid in its opened position.

A line of weakness or cut 135, identical to the cut 23, extends around the forward portion of the container body 103. Rather than having vertical slices at the ends of the cut 135, as shown in FIGS. 1 and 2, the cut 135 has a sloped end, as at 135. (FIG. 7) The sloped end 135 of the slice connects with the scores 123 of the cover line 121. Thus, when the cover 109 is assembled into the body 103 to produce the container 101, the cover front portion 117 can be opened. The cover front portion 117 is substantially the same, and operates in substantially the same manner as the cover front portion 19 of container 1. However, the cover 109 has the tab 129 that engages the membrane or seal 137 when the cover front portion 117 is opened, as seen in FIG. 10. The engagement of the tab 129 with the seal 137 will create a further frictional engagement between the lid and the membrane that will help maintain the cover in its opened position.

Figure 11A:
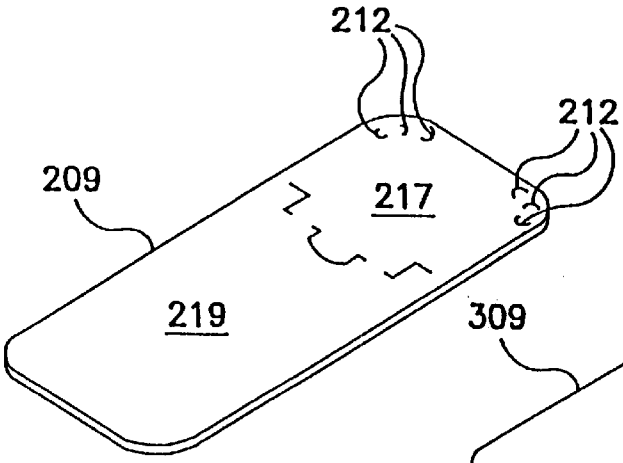
FIG. 11*a* is a perspective view of a blank used to form an alternative lid for the containers of FIGS. 1 and 7, with the lid being closed.
Figure 12A:
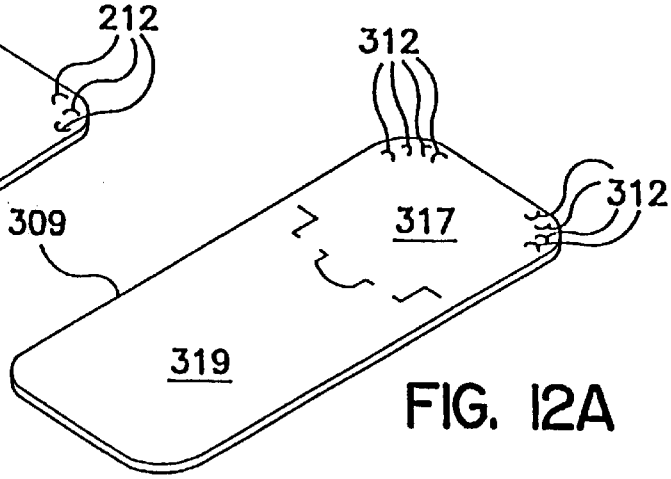
FIG. 12*a* is a perspective view of a blank used to form another alternative lid for the containers of FIGS. 1 and 7, with the lid being closed.
Figure 11B:
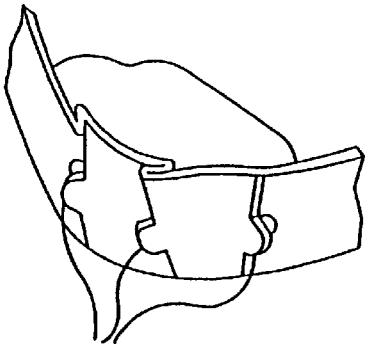
FIG. 11*b* is a perspective view of FIG. 11*a,* showing teeth 212 upon articulation and prior to positioning the container in its sealed orientation.
Figure 12B:
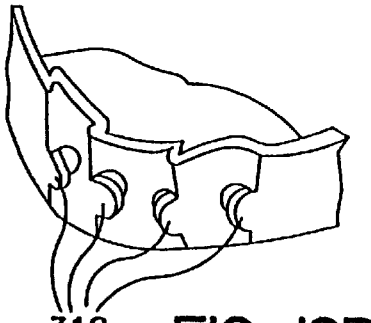
FIG. 12*b* is a perspective view of FIG. 12*a,* showing teeth 312 upon articulation and prior to positioning the container in its sealed orientation.

A third embodiment of the cover member is shown in FIGS. 11–12. The container (not shown) associated with the cover member 209 and 309 of FIGS. 11*a* and 12 is substantially identical in construction to container 1 of FIGS. 1–2. It varies only in the construction of cover member 209. The cover member 209, in turn, is substantially similar to the cover member 109. The difference lies in the peripheral edges of cover front portion 217 and 317. Cover front portion 217 and 317 includes equidistantly-spaced teeth 212 and 312 (FIGS. 11*b* and 12*b*) on its peripheral edges. Engagement of teeth 212 and 312 with the tube body portion (not shown) creates a further frictional engagement between the lid and the membrane that will help maintain cover member 209 and 309 in its closed position.

Figure 13:
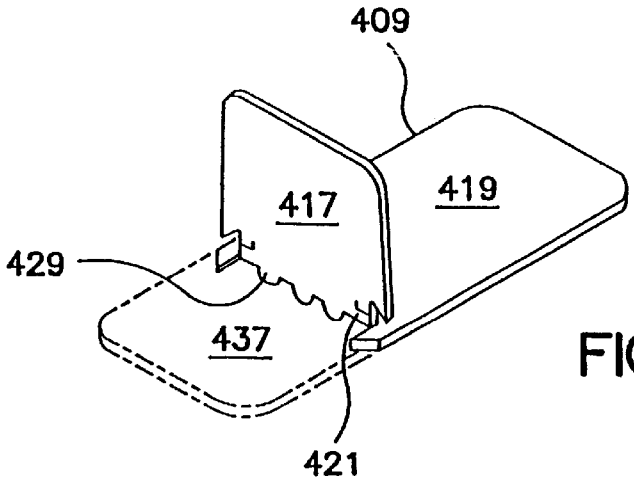
FIG. 13 is a perspective view of a blank used to form yet another alternative lid for the containers of FIGS. 1 and 7, with the lid being open.

A fourth embodiment of the cover member is shown in FIG. 13. The container (not shown) associated with FIG. 13 is substantially identical in construction to container 1 of FIGS. 1–2. It varies only in the construction of cover member 409. The cover member 409, in turn, is substantially similar to cover member 109. The difference lies in line 421 that separates the cover front portion 417 from the cover back portion 419. Line 421 includes three equidistantly-spaced tabs or detentes 429. The tab 429 is formed to extend toward the cover back portion 319. To form each of tabs 429, a partial cut, in a semi-circular shape, is formed on the bottom side of cover back portion 419. The engagement of tabs 429 with the seal 437 creates a further frictional engagement between the lid and the membrane that will help maintain the cover member 409 in its opened position.

Figure 14A:
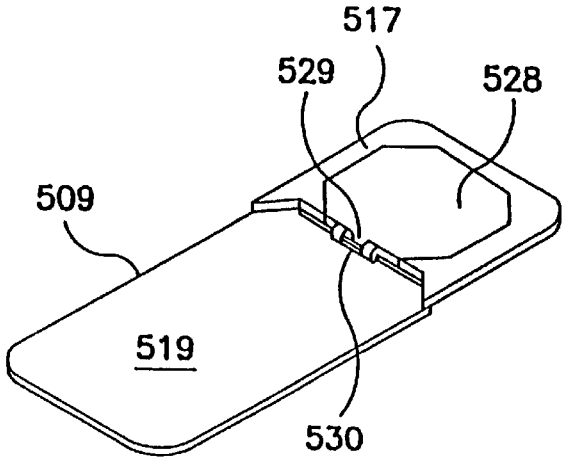
FIG. 14*a* is a perspective view of a blank used to form an alternative lid for the containers of FIGS. 1 and 7, with the lid being closed.
Figure 14B:
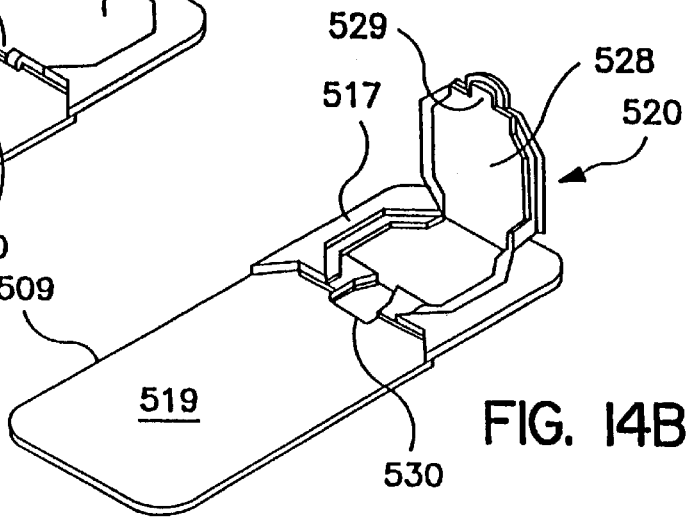
FIG. 14*b* is a perspective view of a blank used to form an alternative lid for the containers of FIGS. 1 and 7, with the lid being open.

A fifth embodiment of the cover member is shown in FIGS. 14*a* and 14*b*. Container (not shown) associated with FIGS. 14*a* and 14*b* is substantially identical in construction to the container 1 of FIGS. 1–2. It varies only in the construction of cover member 509. The cover front portion 517 includes closure assembly 520, which comprises an octagonally-shaped closure 528, tab 529 and slot 530. To secure cover member 509, closure 528 is inserted in slot 530 until tab 529 is in contact with cover front portion 517 (FIG. 14). To maintain cover member 509 in its substantially open, dispensing orientation, closure 528 is manually biased to a position substantially perpendicular to the cover member axis (FIG. 14*b*). Although closure 528 is illustrated as octagonally-shaped, it is likewise contemplated that it may be circular, rectangular, square or any other geometric shape.

Figure 15A:
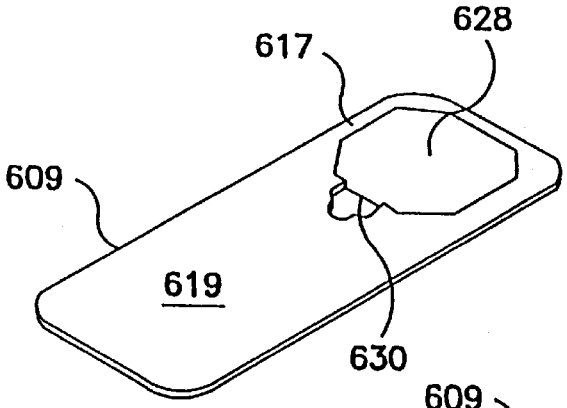
FIG. 15*a* is a perspective view of a blank used to form another alternative lid for the containers of FIGS. 1 and 7, with the lid being closed.
Figure 15B:
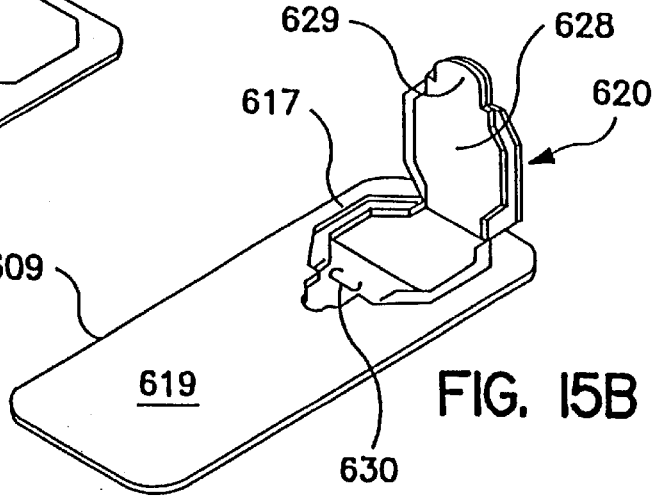
FIG. 15*b* is a perspective view of a blank used to form another alternative lid for the containers of FIGS. 1 and 7, with the lid being open.

A sixth embodiment of the cover member is shown in FIGS. 15*a* and 15*b*. Container (not shown) associated with FIGS. 15*a* and 15*b* is substantially identical in construction to the container 1 of FIGS. 1–2. It varies only in the construction of cover member 609. The cover front portion 617 includes closure assembly 620, which comprises and octagonally-shaped closure 628, tab629 and slot 630. To secure cover member 609, tab is inserted in slot 30 until closure 628 is in contact with cover front portion 617 (FIG. 15*a*). Although closure 628 is illustrated as octagonally-shaped, it is likewise contemplated that it may be circular, rectangular, square or any other geometric The foregoing description and drawings merely explain and illustrate the invention, and the invention is not limited thereto except insofar as the pending claims are so limited as those skilled in the art who have the disclosure before them will be able to make modifications and variations therein without departing from the scope of the invention.

What is claimed is:

1. A paperboard container for releasably dispensing contents contained therein, the container being convertible from a substantially sealed orientation to a substantially open, dispensing orientation and back to the substantially sealed orientation, the paperboard container comprising:

a substantially tubular container member having an upper edge defining an upper opening and a lower edge defining a lower opening;

a paperboard bottom member substantially corresponding in shape to the shape of the lower opening;

a paperboard top member substantially corresponding in shape to the shape of the upper opening, the top member having a front portion, a hinge portion, a back portion, an outer edge and a circumference, the circumference being larger than the circumference of each of the upper edge and the upper opening of the container member, the top member being telescopically received within the upper opening of the container member, with the upper edge of the container member being rolled up over the outer edge of the top member to seal the top member to the paperboard container;

the hinge portion including means for maintaining at least a portion of the to p member front portion in a pivoted position relative to the remainder of the top member, said maintaining means being located substantially adjacent the hinge axis; and at least a portion of the top member front portion being pivotable to the sealed orientation to substantially reseal the container member and a membrane, adhered to the inner surfaces of the container member, positioned below the container top member, a portion of which membrane is positioned below the top member front portion, and remains initially unbroken upon the initial pivoting of the portion of the top member front portion to its pivoted position.

2. The container of claim 1 wherein the top member front portion, includes at least one tooth for engaging the container member upper edge when the top member is in its sealed orientation.

3. The container of claim 1 wherein the top member hinge portion extends generally straight across the top member and the hinge portion buckles under a portion of the top member back portion to create a friction fit that holds the top member front portion in its opened position.

4. The container of claim 3 wherein the hinge portion includes outer portions and an inner portion extending between the outer portions, with the outer portions and the inner portion defining the hinge portion.

5. The container of claim 1 wherein the hinge portion is sized to engage the membrane when the top member front portion is in its open orientation and to hold the front portion in the open orientation.

6. The container of claim 5 wherein the top member hinge portion includes a tab extending rearwardly toward the top member back portion, the tab being sized to engage the membrane when the top member front portion is in its open orientation and to hold the front portion in the open orientation.

7. The container of claim 1 wherein the top member front portion has an opening extending therethrough, the top member hinge portion is positioned within the top member front portion, and the top member hinge portion includes a closure flap extending rearwardly toward the top member back portion for covering the opening, the closure flap being movable from an open orientation to a closed, substantially sealed orientation, resistance at the hinge portion manually biasing the closure flap into both its open and closed orientations.

8. The container of claim 7 wherein the closure flap further includes a tab for facilitating manipulation of the closure flap from a sealed orientation to an open, dispensing orientation.

9. A paperboard container for releasably dispensing contents contained therein, the container being convertible from a substantially sealed orientation to a substantially open, dispensing orientation and back to the substantially sealed orientation, the paperboard container comprising:

a substantially tubular container member having an upper edge defining an upper opening and a lower edge defining a lower opening;

a paperboard bottom member substantially corresponding in shape to the shape of the lower opening;

a paperboard top member substantially corresponding in shape to the shape of the upper opening the top member having a front portion, a hinge portion, a back portion, an outer edge and a circumference, the circumference being larger than the circumference of each of the upper edge and the upper opening of the container member, the top member being telescopically received within the upper opening of the container member, with the upper edge of the container member being rolled up over the outer edge of the top member to seal the top member to the paperboard container;

the hinge portion including means for maintaining at least a portion of the top member front portion in a pivoted position relative to the remainder of the top member, said maintaining means being located substantially adjacent the hinge axis; and at least a portion of the top member front portion being pivotable to the sealed orientation to substantially reseal the container member;

a membrane adhered to inner surfaces of the container member below the container top member;

the hinge portion being sized to engage the membrane when the top member front portion is in its open orientation and to hold the front portion in the open orientation;

the hinge portion further including a pair of outer segments, a pair of inner segments spaced axially from the outer segments, and a pair of axial segments joining the inner and outer segments.

10. The container of claim 9 wherein the top member includes a tab extending between the inner segments of the top member hinge portion.

11. A paperboard container for releasably dispensing contents contained therein, the container being convertible from a substantially sealed orientation to a substantially open, dispensing orientation and back to the substantially sealed orientation, the paperboard container comprising:

a substantially tubular container member having an upper edge defining an upper opening and a lower edge defining a lower opening:

a paperboard bottom member substantially corresponding in shape to the shape of the lower opening;

a paperboard top member substantially corresponding in shape to the shape of the upper opening, the top member having a front portion, a hinge portion, a back portion, an outer edge and a circumference, the circumference being larger than the circumference of each of the upper edge and the upper opening of the container member, the top member being telescopically received within the upper opening of the container member, with the upper edge of the container member being rolled up over the outer edge of the top member to seal the top member to the paperboard container:

the hinge portion including means for maintaining at least a portion of the top member front portion in a pivoted position relative to the remainder of the top member, said maintaining means being located substantially adjacent the hinge axis; and at least a portion of the top member front portion being pivotable to the sealed orientation to substantially reseal the container member:

a membrane adhered to inner surfaces of the container member below the container top member;

the hinge portion being sized to engage the membrane when the top member front portion is in its open orientation and to hold the front portion in the open orientation;

the hinge portion further including at least two tabs extending rearwardly toward the rear portion, the at least two tabs being sized to engage the membrane when the top member front portion is in its open orientation and to hold the front portion in the open orientation.

12. A paperboard container for releasably dispensing contents contained therein, the container being convertible from a substantially sealed orientation to a substantially open, dispensing orientation and back to the substantially sealed orientation, the paperboard container comprising:

a substantially tubular container member having an upper edge defining an upper opening and a lower edge defining a lower opening;

a paperboard bottom member substantially corresponding in shape to the shape of the lower opening;

a paperboard top member substantially corresponding in shape to the shape of the upper opening, the top member having a front portion, a hinge portion, a back portion, an outer edge and a circumference, the circumference being larger than the circumference of each of the upper edge and the upper opening of the container member, the top member being telescopically received within the upper opening of the container member, with the upper edge of the container member being rolled up over the outer edge of the top member to seal the top member to the paperboard container;

the hinge portion including means for maintaining at least a portion of the top member front portion in a pivoted position relative to the remainder of the top member, said maintaining means being located substantially adjacent the hinge axis; and at least a portion of the top member front portion being pivotable to the sealed orientation to substantially reseal the container member;

a membrane adhered to inner surfaces of the container member below the container top member;

the membrane further having a back portion and a front portion, the laminate back portion being substantially equal in width to the width of the top member, and the laminate front portion having a width which is less than the width of the top member and which is substantially equal in width to the width of the container member is made of barrier protective materials.

13. The container of claim 12 wherein the membrane is made of barrier protective materials.

* * * * *